US005680435A

United States Patent [19]

Seissl et al.

[11] Patent Number: 5,680,435

[45] Date of Patent: Oct. 21, 1997

[54] X-RAY DIAGNOSTIC APPARATUS WITH A FILTER DEVICE

[75] Inventors: Johann Seissl; Heinz Eschenbacher, both of Erlangen, Germany

[73] Assignee: Siemens Aktiengesellschaft, Munich, Germany

[21] Appl. No.: 716,985

[22] Filed: Sep. 20, 1996

[30] Foreign Application Priority Data

Sep. 22, 1995 [DE] Germany ..... 295 15 147 U
Apr. 15, 1996 [DE] Germany ..... 196 14 842.1

[51] Int. Cl.[6] ..... G21K 3/00

[52] U.S. Cl. ..... 378/156; 378/157

[58] Field of Search ..... 378/108, 101, 378/110, 112, 116, 156, 157, 158, 159, 97

[56] References Cited

U.S. PATENT DOCUMENTS 4,744,099 5/1988 Huettenrauch et al. ..... 378/157
4,896,037 1/1990 Shimura et al. ..... 378/156
5,287,396 2/1994 Stegehuis ..... 378/156

*Primary Examiner*—Don Wong
*Attorney, Agent, or Firm*—Hill, Steadman & Simpson

[57] ABSTRACT

An X-ray diagnostic apparatus has a device for controlling an X-ray source with regard to the emission of an X-ray beam and a filter positioner for the introduction or removal of at least one radiation filter into or out of the beam of radiation. A monitoring device checks whether there exists a positive difference signal between an output of a dosage power regulator and a kV controller. Given the presence of a positive difference, the monitoring device controls the filter positioner with regard to the removal of the radiation filter from the beam of radiation.

6 Claims, 2 Drawing Sheets

X-RAY DIAGNOSTIC APPARATUS WITH A FILTER DEVICE

BACKGROUND

1. Field of the Invention

The present invention is directed to an X-ray diagnostic apparatus of the type having at least one filter which can be placed in the path of the X-ray beam emitted by the X-ray source.

2. Description of the Prior Art

Filter devices are known which have a number of filters with respectively different radiation absorption characteristics, which are selectively positionable in the path of a beam of radiation transmitted by an X-ray source.

From German OS 33 39 775, an X-ray diagnostic apparatus is known having such radiation filters, with means for the formation of an electrical density signal dependent on the density of a subject under examination. In addition, positioning means for the introduction of the filter are provided, having an electromotor that can be controlled by a control circuit. The density signal is supplied to the control circuit, which controls the electromotor in correspondence to the respective density signal, for the selection of an appropriate filter.

Filters can be placed (such as by rotating a filter holder) in the path of the radiation in order to reduce the patient's skin exposure to radiation. When the filter is rotated into the beam path, the loss of image quality must be compensated by reduction of the tube voltage or by an increase in the image intensifier input dosage. Both result in an increased load on the X-ray source. If the limit of performance is achieved (as happens even for small subject thicknesses, due to the additional filtering), the tube voltage must be increased with a simultaneous reduction of the tube current, if larger subject thicknesses are also to be properly exposed.

SUMMARY OF THE INVENTION

It is an object of the invention to provide an X-ray diagnostic apparatus with at least one filter selectively placable in or out of the X-ray beam path wherein a loss of image quality caused by the additional filter is avoided.

The above object is achieved in accordance with the principles of the present invention in an X-ray diagnostic apparatus having a device for controlling the emission of an X-ray beam from an X-ray source, and a filter positioner for introducing or removing at least one radiation filter into or out of the path of the radiation beam, a monitoring device which determines whether a difference exists between an output of a kV controller and a dosage power regulator, and the monitoring device, given the presence of a difference, controlling the filter positioner with regard to removal of the radiation filter.

An advantage achieved by the invention is that the filter remains in the path of the radiation as long as this is possible without loss of image quality. The filter is not taken out of the path of radiation until there is a danger of an overloading of the X-ray source, or when the voltage at the X-ray source exceeds a predetermined difference value in relation to the target value. The dose can then be reduced by the portion that was necessary for the additional radiation absorption and the compensation of the image quality loss due to the filter, while maintaining the image quality.

DESCRIPTION OF THE PREFERRED EMBODIMENTS

Figure 1:
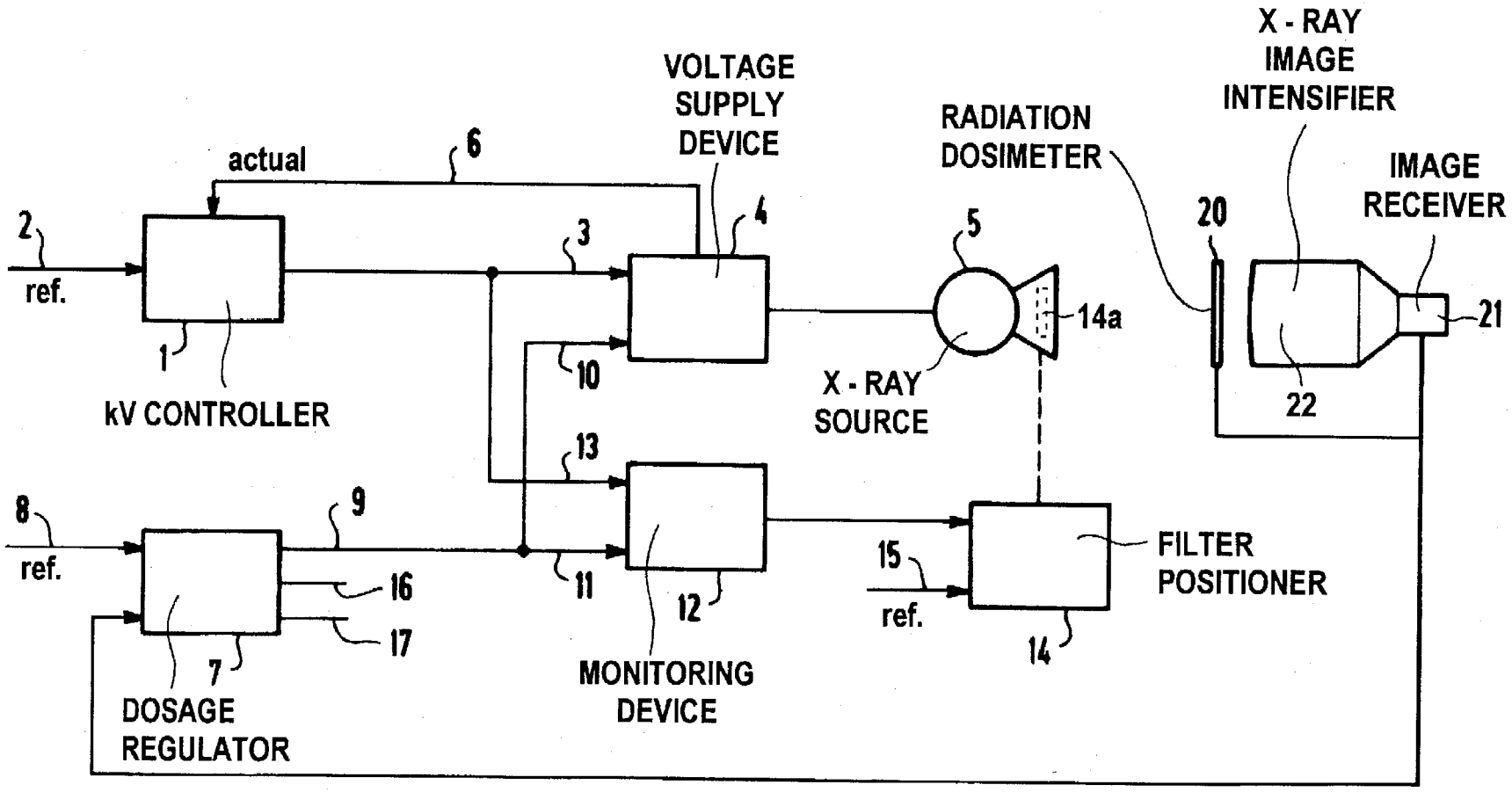
FIG. 1 is a schematic block diagram of an X-ray diagnostic apparatus constructed in accordance with the principles of the present invention.

In FIG. 1, a kV controller has an input 2 to which a kV target (reference) signal can be fed. The output of the kV controller 1 is connected to a first input 3 of a voltage supply device 4 for an X-ray source 5, with a feedback branch 6 leading back to the kV controller 1. A target signal is fed to a dosage regulator 7 at a first input 8. A first output 9 of the dosage regulator 7 is connected to a second input 10 of the voltage supply 4 and to a first input 11 of a monitoring device 12. The output signal of the kV controller 1 is fed to a second input 13 of the monitoring device 12. A filter positioner 14 is connected after the monitoring device 12. A signal identifying the desired filter is fed to the filter positioner 14 at an additional input 15. The filter positioner 14 either places a desired filter 14*a* in the path of the beam from the X-ray source 5, or removes it therefrom. The dosage regulator 7 can generate, if warranted, a signal for the regulation of the beam from the X-ray source at a second output 16, and a signal for time control at a third output. These signals are, however, not essential for the invention, and are thus not further discussed.

Figure 2:
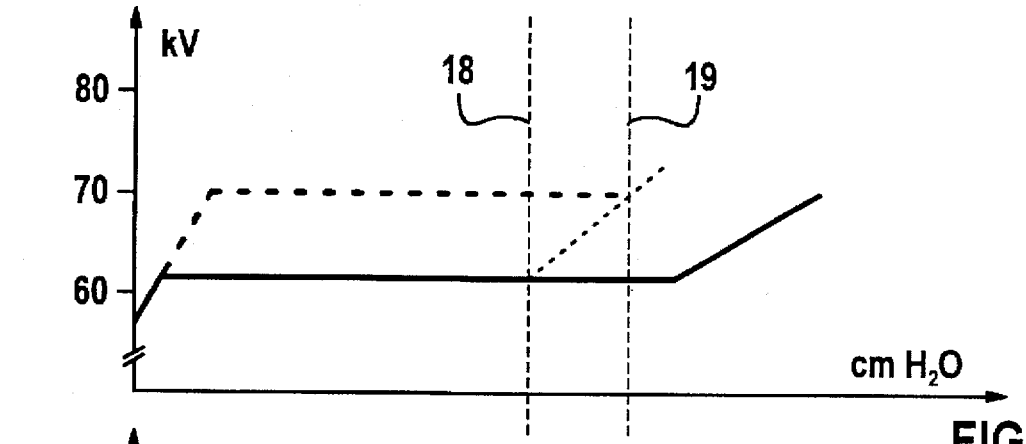
FIGS. 2 through 5 are diagrams for explaining the operation of the apparatus of FIG. 1.
Figure 3:
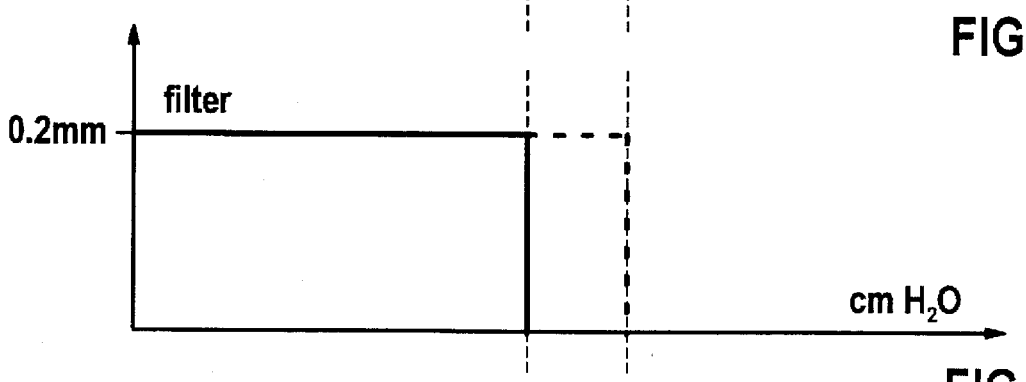
Figure 4:
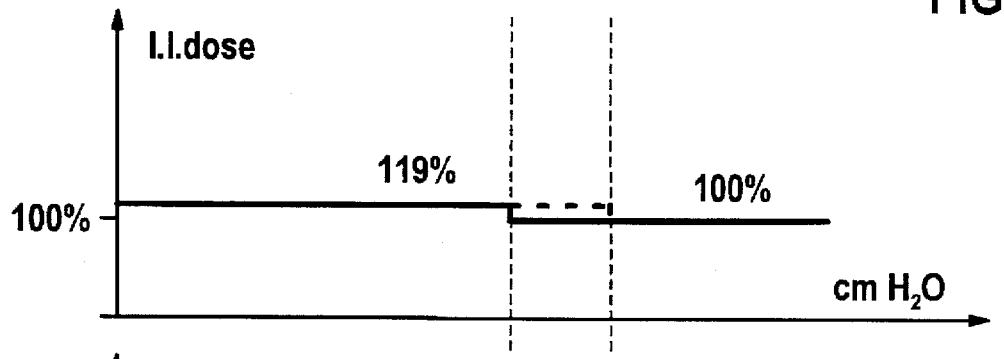
Figure 5:
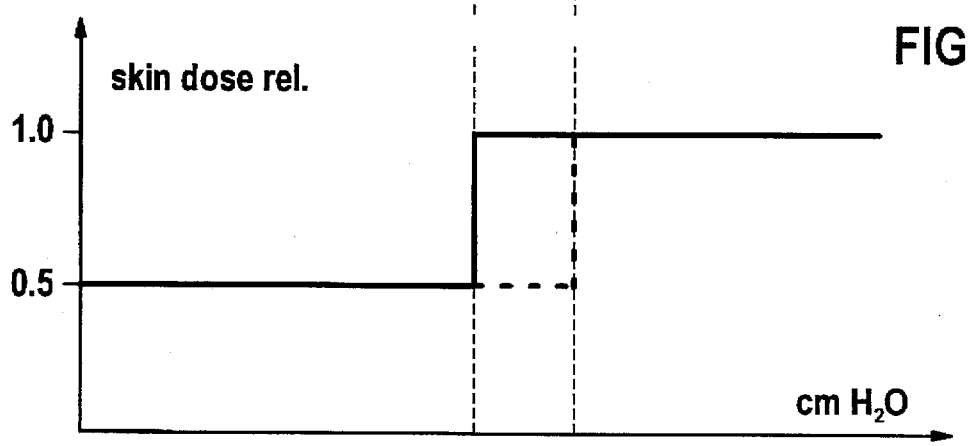

If, for example, a desired voltage level is chosen at the kV controller 1 of e.g. 63 kV, and at the second input 15 of the filter positioner 14 a filter 14*a* of 0.2 mm copper (for the reduction of skin radiation exposure) is chosen, the filter 14*a* is left in the path of radiation until the limit of performance of the X-ray source 5 is reached. If the limit of performance, as shown in FIG. 2, is reached at the line identified with reference numeral 18, the dosage regulator 7 controls the voltage for the X-ray source 5 at a high level and decreases the X-ray source current. The monitoring device 12 detects this increase in voltage as a difference from the target value (63 kV), and generates an output signal for controlling the filter positioner 14 with regard to the removal of the 0.2 mm copper filter 14*a*, and replaces it with the next thinner filter, or takes the filter 14*a* completely out of the path of radiation without inserting a replacement filter (FIG. 3). Due to the use of the filter 14*a*, it has been necessary to raise the radiation dose, e.g., to 119%, in order to compensate for the loss of contrast caused by the filter while maintaining image quality. Since, however, the filter 14*a* has subsequently been taken out of the path of radiation, the dose for an equal image quality can be reduced to 100%, which also reduces the load on the X-ray source 5 (FIG. 4). FIG. 5 shows that the skin radiation exposure then increases, however.

In FIGS. 2 to 5, the removal of the filter, the reduction of the dose and the increase of the skin radiation exposure is shown in unbroken lines, with the assumption of a voltage level of 70 kV. The load limit of the X-ray source 5 is reached at the line identified with reference numeral 19. The filter 14*a* is also taken out of the path of radiation only when the monitoring device 12 detects a positive voltage difference.

By means of the invention it is thus achieved that the image quality is maintained by the automatic removal of the filter 14*a*.

Within the scope of the invention, the X-ray diagnostic apparatus can include a display for indicating the radiation filter currently located in the path of radiation. The dosage regulator 7 can be a dose controller, as previously described. In this case, the actual value is measured by a radiation dosimeter 20 before the X-ray image intensifier 22. The dosage regulator 7 can, however, alternatively be a brightness controller, which uses the brightness at the output of the X-ray image intensifier 22 as an actual value. This brightness can also be obtained, for example, from an image signal (video signal) from an image receiver 21, such as a video camera.

Although modifications and changes may be suggested by those skilled in the art, it is the intention of the inventors to embody within the patent warranted hereon all changes and modifications as reasonably and properly come within the scope of their contribution to the art.

We claim as our invention:

1. An X-ray diagnostic apparatus comprising:

an X-ray source which emits an X-ray beam;

at least one radiation filter and filter positioning means for introducing and removing said at least one radiation filter into and out of said radiation beam;

a voltage supply device which supplies said X-ray source with an operating voltage;

a kV controller and a dosage power regulator which generate respective output signals supplied to said voltage supply device for adjusting and setting said operating voltage; and monitoring means for determining whether a difference exists between the output of said dosage power regulator and the output of said kV controller and for, giving the presence of a difference, controlling said filter positioning means with respect to removal of said at least one radiation filter from said radiation beam.

2. An X-ray diagnostic apparatus as claimed in claim 1 wherein said monitoring means comprises means for determining whether a positive difference exists between the output of said dosage power regulator and the output of said kV controller and, giving the presence of a positive difference for controlling said filter positioning means with regard to removal of said at least one radiation filter.

3. An X-ray diagnostic apparatus as claimed in claim 1 further comprising a radiation dosimeter, disposed in said X-ray beam, for measuring an actual radiation dose, and wherein said monitoring means includes means for identifying whether a negative difference exists between said actual radiation dose and a reference dose and for, given the presence of a negative difference, controlling said filter positioning means with regard to removal of said at least one radiation filter.

4. An X-ray diagnostic apparatus as claimed in claim 1 further comprising an X-ray image intensifier on which said X-ray beam is incident, said X-ray image intensifier generating an output optical image having a brightness value associated therewith, and wherein said monitoring means comprises means for determining whether a negative difference exists between said brightness value and a reference brightness value and for, given the presence of a negative difference, controlling said filter positioning means with regard to removal at least one radiation filter.

5. An X-ray diagnostic apparatus as claimed in claim 1 wherein said filter positioning means comprises means for removing said at least one radiation filter and replacing at least one radiation filter with a different filter, having a lower radiation absorption than at least said one radiation filter, upon receiving a signal from said monitoring means.

6. An X-ray diagnostic apparatus as claimed in claim 5 further comprising means for displaying an identification of the radiation filter currently located in said radiation beam.

* * * * *